United States Patent [19]

Muessel

[11] 4,452,429

[45] Jun. 5, 1984

[54] PLANETARY GEAR WINCH COMPRISING SELECTIVELY OPERABLE FREEWHEEL ARRANGEMENT

[75] Inventor: Dan C. Muessel, Danvers, Mass.

[73] Assignee: Rule Industries, Inc., Gloucester, Mass.

[21] Appl. No.: 327,344

[22] Filed: Dec. 4, 1981

[51] Int. Cl.[3] ..... B66D 1/22

[52] U.S. Cl. ..... 254/344; 254/345

[58] Field of Search ..... 254/344, 345, 297, 298

[56] References Cited

U.S. PATENT DOCUMENTS

| | | | |
|---|---|---|---|
| 1,273,747 | 7/1918 | Davidoff | 254/344 X |
| 2,500,326 | 3/1950 | Shaff | 254/344 |
| 3,165,297 | 1/1965 | Thompson et al. | 254/344 |
| 3,319,492 | 5/1967 | Magnuson | 254/345 X |
| 4,161,126 | 7/1979 | Winzeler | 254/345 X |
| 4,185,520 | 1/1980 | Henneman | 254/344 X |

FOREIGN PATENT DOCUMENTS

| | | | |
|---|---|---|---|
| 1123450 | 2/1962 | Fed. Rep. of Germany | 254/345 |

*Primary Examiner*—John M. Jillions

[57] ABSTRACT

There is disclosed a planetary gear winch comprising a selectively operable freewheel arrangement therefor. The freewheel arrangement of the invention provides the winch operator with the ability to disengage the winch drum from the planetary gear reduction drive train, under no-load conditions, thereby to allow free-wheeling rotation of the winch drum and rapid unwinding of line therefrom.

10 Claims, 2 Drawing Figures

PLANETARY GEAR WINCH COMPRISING SELECTIVELY OPERABLE FREEWHEEL ARRANGEMENT

BACKGROUND OF THE INVENTION

The present invention relates generally to winches of the planetary gear type and is more particularly concerned with a planetary gear winch construction comprising a freewheel arrangement for selectively disengaging the winch drum from the power train under no-load conditions.

A planetary gear winch broadly comprises a prime mover coupled to a winch drum through a planetary gear reduction drive train. The planetary gear reduction drive train comprises at least two serial, coacting and coaxially oriented planetary gear reduction stages, each stage comprising a plurality of planet gears journalled in a carrier therefor, said planet gears surrounding and being in engagement with a central sun gear. Each planetary gear reduction stage also comprises a ring gear surrounding and being in engagement with said planet gears, said ring gear acting as a fixed reaction member. While separate and distinct ring gears may be utilized for each planetary gear reduction stage it is conventional to employ a single ring gear of sufficient length to house and serve the entire complement of planetary gear reduction stages, thereby simplify the construction and/or to render it more economic. Rotary power is delivered into each planetary gear reduction stage through the centrally located sun gear thereof. In the case of the first reduction stage, the sun gear is driven by the prime mover. In the case of later stages, the sun gears are each driven by the output of the previous planetary gear reduction stage. The planet gears of each reduction stage are carried in a planet carrier generally comprising a plate member having a plurality of axle stubs extending perpendicularly from one surface thereof and to which axle stubs the planet gears are journalled. Conventionally, the planet carrier for each of the planetary gear reduction stages preceding the final reduction stage also comprises a centrally located sun gear rigidly affixed thereto and extending downstream therefrom, said sun gear acting, as previously mentioned, as the power input member for the suceeding planetary gear reduction stage.

The power output of the final planetary ger reduction stage is coaxially coupled to the winch drum in any suitable manner. For example, the planet carrier of the final planetary gear reduction stage and the bore of the winch drum élement can each define a keyway or splined recess, which recesses receive a common suitably conformed key or spline coupling member. As another example, the upstream flange of the winch drum can serve as the planet carrier for the final planetary gear reduction stage, thereby to simplify the construction of said stage and to provide a direct coupling of the output thereof to the winch drum. In this last-mentioned arrangement, axle stubs extend upstream from the upstream winch drum flange and the planet gears of the final reduction stage are journalled thereto. Thus, said planet gears are caused to act as the power output members of the final planetary gear reduction stage driving the winch drum through said axle stubs. Another example of suitable coaxial coupling of a final planetary gear reduction stage to a winch drum is disclosed in U.S. patent application Ser. No. 197,654 Muessel et al., filed Oct. 16, 1980, entitled Rotary Power Coupling and Planetary Gear Winch Comprising Same, now U.S. Pat. No. 4,392,635, July 12, 1983. Therein there is disclosed a flexible coupling arrangement employing an intermediate plateform coupling member whereby the planetary gear train is effectively isolated from racking loads imposed on the winch drum during operations.

It is in the nature of a planetary gear reduction train that the forces required to drive the train in reverse, when applied rearwardly through the final reduction stage of the gear train, are relatively great. This inherent characteristic of planetary gear reduction trains is employed to advantage in winch applications in that, when the prime mover is inactivated, the planetary gear train acts to produce a substantial braking of the winch drum against reverse rotation thereof under line load. Where the load capacity of the winch is substancial it is also conventional to provide various supplemental mechanical and/or electrical braking systems to mitigate against unintentional reverse rotation of the winch drum upon shutdown of the prime mover. Generally speaking, such supplemental braking systems are located upstream from the planetary gear train thereby to ensure that full use is made of the inherent braking effects of the planetary gear reduction train and to minimize the bulk and complexity required of the supplemental braking system.

In many planetary gear winch applications it is highly desirable that the winch be provided with means by which the winch drum, in the unloaded condition, can be temporarily disconnected from the drive train therefor, thereby to be rendered freely rotatable and to allow rapid unwinding of the line therefrom. This is a particularly desirable feature, for instance, in connection with off-the-road vehicle and boat trailer winch applications wherein a lone operator may be called upon to deploy the line from the winch drum, affix it to a fixed object or to a load and place the winch in operation. In accordance with the present invention, a winch construction comprising such selectively operable freewheel arrangement is provided.

OBJECTS OF THE INVENTION

It is a principal object of the present invention to provide a planetary gear winch comprising a novel selectively operable freewheel arrangement therefor.

It is still another object of the invention to provide a planetary gear winch drum which, in the freewheel condition, has imparted thereto a light drag, thereby to mitigate against overrunning of the drum during unwinding of line therefrom.

It is yet another object of the invention to provide a planetary gear winch comprising a selectively operable freewheel arrangement therefor which is operable substantially only when the winch drum is free of line load.

Other objects and advantages of the present invention will, in part, be obvious and will, in part, appear hereinafter.

SUMMARY OF THE INVENTION

The winch of the invention comprises a planetary gear reduction train comprising at least two planetary gear reduction stages including a final planetary gear reduction stage and a penultimate planetary gear reduction stage. The final planetary gear reduction stage is coaxially coupled to a winch drum having a central passageway through the drum element thereof. A selector shaft is received in a freely slidable manner through said passageway. To the upstream interior end of said selector shaft there is journalled the sun gear driving the final planetary gear reduction stage. The planet carrier of the penultimate planetary gear reduction stage comprises a centrally located internal gear adapted to engage the upstream portion of said final stage sun gear in driving relationship therewith. The selector shaft passes through the passageway and terminates exteriorly of the winch drum element. A two-position manually operable stop means is provided in association with said selector shaft to position the upstream portion of the sun gear journalled to the interior end thereof in either a first "engaged" position or a second "disengaged" position with respect to the internal gear of the penultimate reduction stage planet carrier. Biasing means are provided to continuously urge said selector shaft and the sun gear journalled thereto to stroke towards the first "engaged" position.

THE DRAWING

FIG. 1 hereof is a schematic, diagrammatic, partially sectional side view of a planetary gear winch in accordance with the invention showing, in solid lines, the arrangement of the planetary gear reduction train elements thereof in the "engaged" position and, in phantom, the arrangement of said elements in the "disengaged" position.

FIG. 2 hereof is a schematic, diagrammatic, partially phantom, exploded perspective view showing the penultimate planetary gear reduction stage, the final planetary gear reduction stage and the winch drum components of the embodiment of the invention shown in FIG. 1.

DESCRIPTION OF PREFERRED EMBODIMENTS

Figure 1:
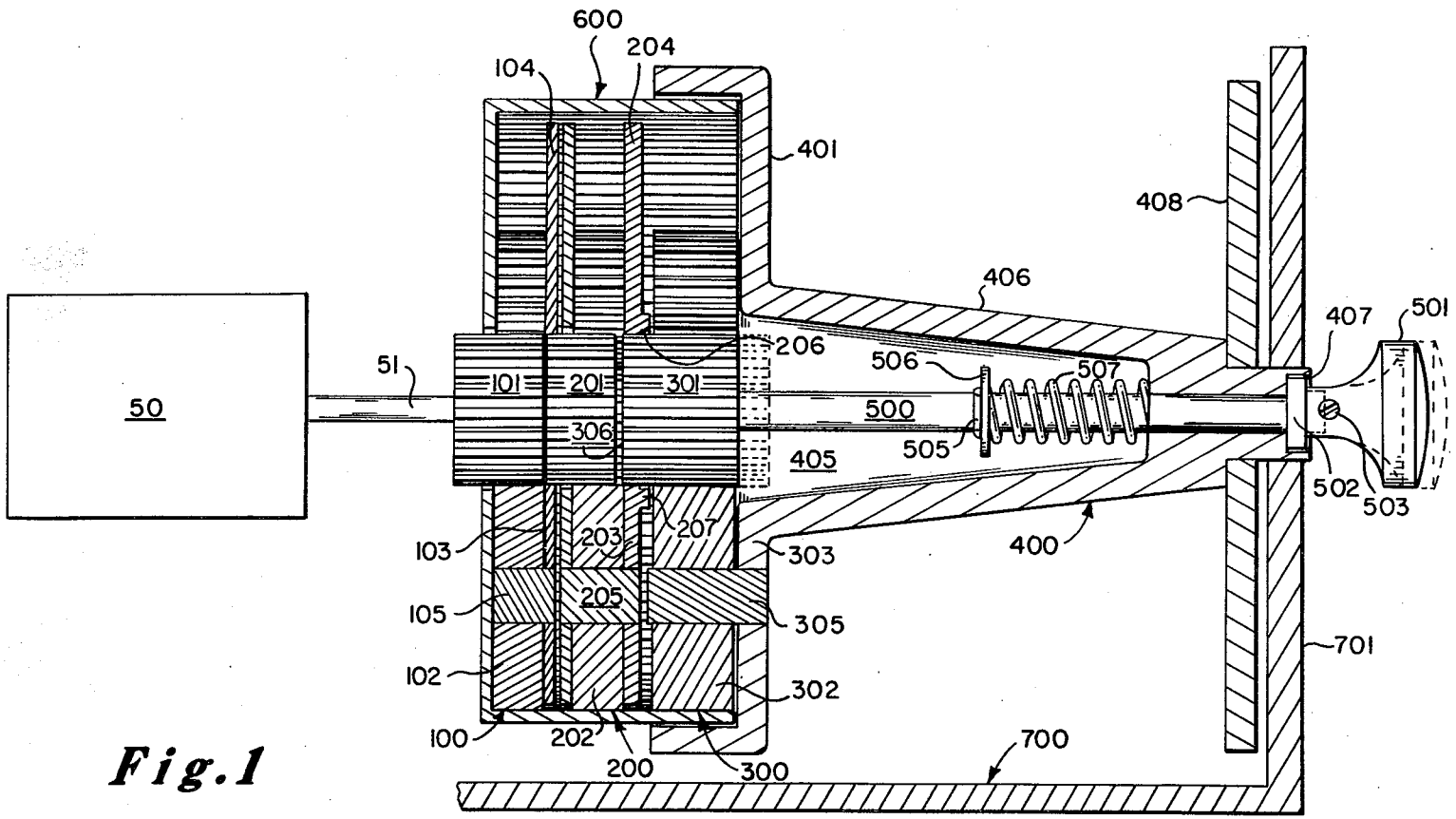
Figure 2:
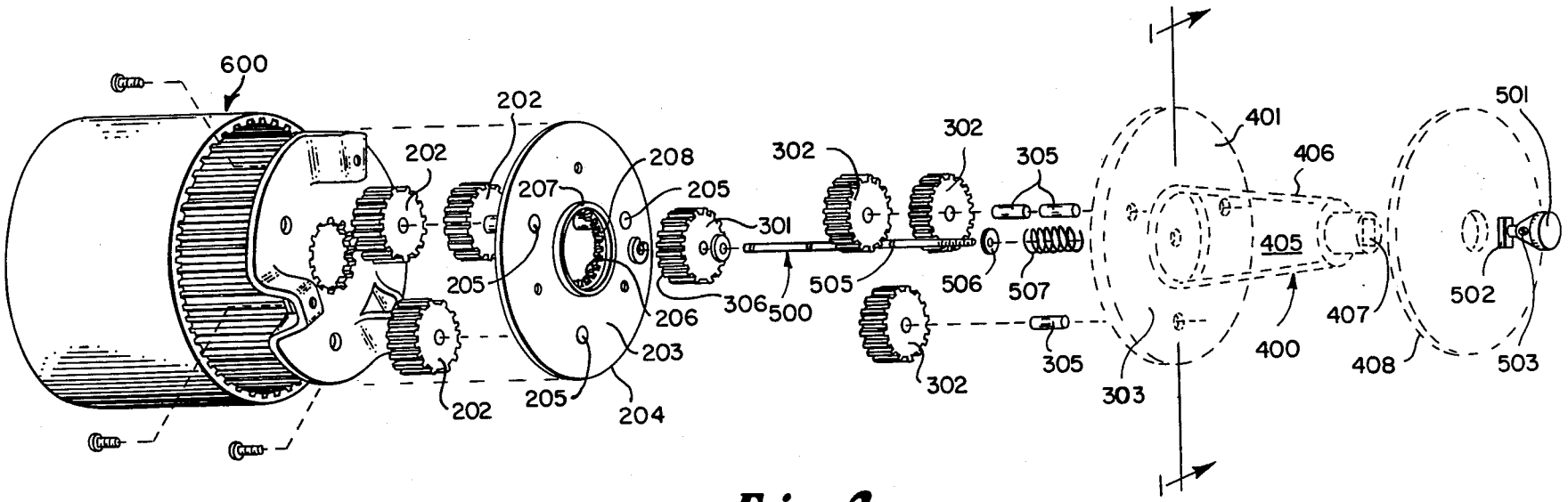

Referring now to the drawing, wherein like reference numerals refer to like structures, the planetary gear winch of the invention broadly comprises a prime mover 50, a plurality of planetary gear reduction stages 100, 200 and 300, respectively, and a winch drum 400. The prime mover 50 will usually, but not necessarily, be represented by a high torque D.C. electric motor. Where a D.C. motor is employed as the prime mover 50, it will also usually be preferred to employ power supply circuitry therefor which results in shunting of the current directly across the terminals of the motor during periods of inactivity thereof. This causes the prime mover 50 to act as a generator during such periods of inactivity, thus to further act as a dynamic supplemental brake for the winch drum 400.

The output shaft 51 of prime mover 50 is secured to a sun gear 101 which represents the power input to the first planetary gear reduction stage 100. Stages 200 and 300 represent the penultimate and final planetary gear reduction stages, respectively, of the particular embodiment of the invention shown in the drawing. Planetary gear reduction stages 100, 200 and 300 comprises sun gears 101, 201 and 301, respectively; a plurality of planet gears 102, 202 and 302 respectively, said planet gears of each stage being arranged about and in engagement with their corresponding sun gears 101, 201 and 301. Additionally, a fixed "reaction" ring gear 600 is disposed over and in engagement with each of the planet gears 102, 202 and 302 of stages 100, 200 and 300. Planet gears 102 and 202 are carried by planet carriers 103 and 203, respectively. Said carriers 103 and 203 each comprise a sturdy metallic plate member 104 or 204 to which plate members there are affixed a number of appropriately positioned axle stubs 105 or 205 extending perpendicularly therefrom and to which axle stubs the corresponding planet gears 102 or 202 are journalled. In planetary gear winches of the prior art the sun gear of each planetary gear reduction stage, other than the first stage, is usually rigidly affixed to the planet carrier of the preceding planetary gear reduction stage. In the three-stage planetary gear reduction train shown in the drawings, this rigid fixation of the sun gear to the preceding stage planet carrier is preserved in respect of sun gear 201 of the penultimate planetary gear reduction stage 200. Said sun gear 201 is, accordingly, rigidly affixed to the downstream surface of plate member 104 of the planet carrier 103 of the first planetary bger reduction stage 100.

In the particular embodiment of the invention shown in the drawing, the final planetary gear reduction stage 300 differs from the preceding planetary gear reduction stages 200 and 100 in that the final stage planet carrier 303 is defined by the upstream end flange 401 of winch drum 400. Accordingly, the planet gears 302 of the final planetary gear reduction stage 300 are journalled to axle stubs 305 which extend perpendicularly upstream from the upstream surface of end flange 401. It should be noted and understood, however, that the foregoing differences in the construction of the final planetary gear reduction stage 300 of the particular embodiment of the invention shown in the drawing, while representing one generally suitable arrangement for coupling the final planetary gear reduction stage to the winch drum 400, is not critical in respect of the invention and is shown and described merely by way of illustration.

As mentioned previously, in planetary gear winches of the prior art it is conventional to rigidly affix the sun gear of each planetary gear reduction stage (other than that of the first stage) to the planet carrier of the preceding stage. In the present invention, however, the sun gear 301 of the final planetary gear reduction stage 300 is not rigidly affixed to the planet carrier 203 of penultimate planetary gear reduction stage 200. Rather, plate member 204 of planet carrier 203 is provided with a centrally located internal gear 206 which is sized so as to slidably receive the upstream end portion of sun gear 301 in driving relationship therewith. In a preferred embodiment of the invention, the plate member 204 of the penultimate planetary gear reduction stage planet carrier 203 is provided with a retainer ring 207 jutting outwardly from the downstream surface thereof, said ring 207 coaxially surrounding the internal gear 206. The internal diameter of retainer ring 207 is sufficient to receive the upstream end of sun gear 301 therein in a loose slip-fit relationship therewith. The principal function of retainer ring 207 is to loosely retain the upstream end of sun gear 301 therein in the second "disengaged" or "freewheel" position of the arrangement of the invention and to thereby maintain axial alignment of said gear 301 relative to the internal gear 206. This, of course, serves to minimize difficulty in remeshing of gears 206 and 301 upon operation of the arrangement of the invention into the first "engaged" condition. Generally speaking, this alignment function has been found to be adequately served where the internal diameter of the retainer ring 207 is greater by a few thousandths of an inch than the diameter of the sun gear 301. As a further aid to the engagement of gears 206 and 301, it is also desirable that the upsteam ends 306 of the teeth of sun gear 301 be chamfered and/or that the downstream edges 208 of the involute tooth surfaces on internal gear 206 each be chamfered.

Sun gear 301 of final planetary gear reduction stage 300 is journalled to the interior end of selector shaft 500, said shaft passing in a freely slidable manner through passageway 405 formed through the axis of rotation of drum element 406 of winch drum 400 and terminating exteriorly thereof. The downstream end portion of drum element 406 first passes through and is affixed to downstream end flange 408. Thereafter, said downstream end portion of drum element 406 passes through and is journalled to a suitably sturdy end frame element 701 of winch frame 700. The downstream end of selector shaft 500 passes through the downstream end of element 406 and is affixed to a manipulative control member 501, which member 501 can conveniently take the form of an easily grasped knob. In addition, the selector shaft 500 and the drum element 406 are provided with mutually cooperative two-position stop means so as to define both "engaged" and "disengaged" stroke limits for the selector shaft 500. In the particular embodiment shown in the drawing said two-position stop means comprises an elongate wind member 502 affixed to the upstream end of control member 501. Cooperating with said wing member 502, the downstream end of drum element 406 comprises an elongate recess 407 which is shaped to receive wing member 502 therein. The length of selector shaft 500 defined between sun gear 301 and wing member 502 is selected such that, when wing member 502 is received and bottomed within the recess 407, the upstream end portion of sun gear 301 is placed in mesh with the internal gear 206. This association, of course, defines the first or "engaged" position of the arrangement of the invention whereby the winch drum 400 is in driven relationship with the planetary gear train and the prime mover 50. In order to provide means by which the length dimension of selector shaft 500 between the sun gear 301 and wing member 502 can be conveniently adjusted, it is preferred that said wing member 502 and control member 501 be threaded to receive the correspondingly threaded downstream end portion of selector shaft 500. Adjustment of the aforementioned length dimension can then be had by rotating selector shaft 500 inwardly or outwardly relative to the wing member 502/control member 501 combination and then tightening set screw 503, thereby securing the wing member 502 at a fixed position relative to the selector shaft 500.

The depth of recess 407 controls the dimension of the stroke of selector shaft 500 between the first "engaged" and second "disengaged" positions thereof. Accordingly, the depth of the recess 407 is selected such that, when control member 501 is pulled outwardly and selector shaft 500 and wing member 502 rotated to be crosswise with respect to recess 407 and the upstream surface of wing member 502 brought into contact with the downstream end of drum element 406, there results a translation of the sun gear 301 from internal gear 206 sufficient to bring said gears 301 and 206 out of mesh. This defines the second or "disengaged" position of the arrangement of the invention whereby the winch drum 400 is in the freewheel mode and line may be unwound therefrom without interference from the drive train of the winch. Of course, utilizing the preferred embodiment wherein the planet gear carrier 203 of the penultimate planetary gear reduction stage 200 comprises retainer ring 207, the depth of recess 407 should also be selected such that, in the second or "disengaged" position of selector shaft 500, the upstream end portion of sun gear 301 will be out of mesh with internal gear 206 but will also remain within the confines of said retainer ring 207.

Desirably selector shaft 500 is also provided with means to continuously bias same towards the first "engaged" position thereof. Said biasing means can conveniently take the form shown in the drawing wherein selector shaft 500 is provided with a circumferential groove or raceway 505 at a location within the passageway 405 of drum element 406. Nested within said groove 505 is a sturdy washer 506. A compression spring 507 of suitable length and compression properties is disposed over the selector shaft 500 and is maintained in a compressed state between washer 507 and the downstream end portion of drum element 406, thereby establishing a continuous bias of the selector shaft 500 towards the first "engaged" position. The functional roles played by this biasing means are to aid in maintaining the arrangement of the invention in the selected mode of operation; to ensure that, in the first "engaged" mode, wing member 502 is firmly bottomed in recess 407, thereby to assure firm and accurate meshing of the upstream end portion of sung gear 301 within internal gear 206; and to ensure that, in the second "disengaged" position, wing member 502 is securely bottomed on the downstream end surface of drum element 406.

Where the planetary gear winch arrangement of the invention is in the first "engaged" position and is also experiencing a substantial line load, sun gear 301 is inherently very firmly in mesh with the internal gear 206 of planet carrier 203. In this loaded condition of the winch the selector shaft 500 and sun gear 301 carried thereon cannot normally be manually withdrawn to the second "diesngaged" position without relatively extreme effort on the part of the operator. This of course, represents a substantial benefit accuring to the invention since it mitigates strongly against accidental disengagement and release of the winch drum when under a line load and serves to allow such disengagement to occur only when the winch drum 400 is in the unloaded state.

In the embodiment of the invention wherein the planet carrier of the final planetary gear reduction stage is defined by upstream end flange 401 of the winch drum 400 there usually occurs a very light drag or resistance to rotation of the winch drum in the second "disengaged" condition. This light drag is occasioned by bearing friction and the presence of the usual grease or viscous oil lubricant serving the planetary gear stages and is geneficial since it mitigates against overrunning of the winch drum during unwinding of line therefrom.

What is claimed is:

1. In a planetary gear winch construction comprising a prime mover coupled to a planetary gear reduction drive train, said drive train comprising at least two planetary gear reduction stages, the final one of said stages being coaxially coupled to a winch drum and each planetary gear reduction stage comprising an input sun gear, a plurality of planet gears journalled in a planet carrier therefor and a fixed ring gear, said planet gears being arranged about and engaged with said sun gear and said ring gear surrounding and being engaged with each of said planet gears, the improvement which comprises a selectively operable freewheel arrangement comprising:

the planet carrier of the penultimate planetary gear reduction stage comprising a centrally located internal gear;

the sun gear of the final planetary gear reduction stage being slidably engageable with said internal gear of said planet carrier of said penultimate planetary gear reduction stage;

a selector shaft having upstream and downstream ends;

said sun gear of the final planetary gear reduction stage being journalled to the upstream interior end of said selector shaft;

said winch drum having a drum element comprising a passageway for receiving said selector shaft therethrough in freely slidable relationship therewith, the downstream end portion of said shaft terminating exteriorly of said passageway;

the exterior end portion of said selector shaft having means for manipulating said shaft to and fro within said passageway;

said selector shaft comprising two-position stop means defining a first engaged position and a second disengaged position of the sun gear journalled thereto with respect to said internal gear.

2. The improved winch construction of claim 1 comprising, in addition, means to continously bias said selector shaft towards said first engaged position thereof.

3. The improved winch construction of claim 1 wherein the downstream surface of said planet carrier of said penultimate planetary gear reduction stage comprises a retainer ring coaxially surrounding said internal gear and extending downstream therefrom, said retainer ring having an internal diameter sufficient to receive the upstream end portion of said sun gear therein in loose, slip-fit relationship therewith.

4. The improved winch construction of claim 3 wherein said stop means defining said second disengaged position positions the upstream end of said sun gear within said retainer ring.

5. The improved winch construction of claim 1 wherein the upstream ends of the teeth of said sun gear are chamfered.

6. The improved winch construction of claim 1 wherein the downstream edges of the involute tooth surfaces of said internal gear are chamfered.

7. The improved winch construction of claim 2 wherein said biasing means comprising, in combination: a circumferential groove located on said selector shaft within said passageway of said drum element; a washer seated within said groove and a compression spring disposed over said selector shaft downstream of said washer, said spring being of a length sufficient to be placed into a compressed state between said washer and the downstream interior end of said passageway.

8. The improved winch construction of claim 1 wherein the planet carrier of the final planetary gear reduction stage is defined by the upstream end flange of said winch drum.

9. The improved winch construction of claim 1 wherein said two-position stop means comprises, in combination: an elongate wing member threadingly affixed to the downstream exterior end portion of said selector shaft and an elongate recess located in the downstream exterior end of said drum element, said recess being of a shape adapted to receive said elongate wing member therein, the depth of said recess being selected to cause said sun gear journalled to said shaft to be placed in said first engaged position upon bottoming of said wing member in said recess and to cause said sun gear to be taken into said second disengaged position upon bottoming of said wing member against the downstream end of said drum element crosswise to said elongate recess.

10. The improved winch construction of claim 3 wherein said two-position stop means comprises, in combination: an elongate wing member threadingly affixed to the downstream exterior end portion of said selector shaft and an elongate recess located in the downstream exterior end of said drum element, said recess being of a shape adapted to receive said elongate wing member therein, the depth of said recess being selected to cause said sun gear journalled to said shaft to be placed in said first engaged position upon bottoming of said wing member in said recess and to cause said sun gear to be taken into said second disengaged position while retaining the upstream end thereof within the confines of said retainer ring upon bottoming of said wing member against the downstream end of said drum element, crosswise to said recess.

* * * * *